US008608437B1

(12) United States Patent
Cantin, Jr.

(10) Patent No.: US 8,608,437 B1
(45) Date of Patent: Dec. 17, 2013

(54) PORTABLE AIR DISPLACEMENT SYSTEM

(71) Applicant: Reinaldo Cantin, Jr., Miami Springs, FL (US)

(72) Inventor: Reinaldo Cantin, Jr., Miami Springs, FL (US)

( * ) Notice: Subject to any disclaimer, the term of this patent is extended or adjusted under 35 U.S.C. 154(b) by 0 days.

(21) Appl. No.: 13/689,273

(22) Filed: Nov. 29, 2012

Related U.S. Application Data

(63) Continuation-in-part of application No. 12/555,712, filed on Sep. 8, 2009, now abandoned.

(60) Provisional application No. 61/191,215, filed on Sep. 8, 2008.

(51) Int. Cl.
*F03B 11/02* (2006.01)

(52) U.S. Cl.
USPC ..... 415/206; 416/63

(58) Field of Classification Search
USPC ..... 415/203, 206, 204, 208.1, 211.1, 183, 415/184; 416/63; 417/234
See application file for complete search history.

(56) References Cited

U.S. PATENT DOCUMENTS

| | | | | |
|---|---|---|---|---|
| 2,826,758 | A | 3/1958 | Kahn | |
| 3,096,702 | A | 7/1963 | Malone, Sr. et al. | |
| 5,217,408 | A | 6/1993 | Kaine | |
| D339,858 | S | 9/1993 | Shong | |
| 5,564,124 | A | 10/1996 | Elsherif et al. | |
| 6,125,636 | A | 10/2000 | Taylor et al. | |
| 6,188,881 | B1 * | 2/2001 | Braxton | 455/351 |
| 6,543,247 | B2 * | 4/2003 | Strauss | 62/259.3 |
| 6,666,647 | B1 | 12/2003 | Trask | |
| 6,955,524 | B2 | 10/2005 | Stengel | |
| 7,828,524 | B2 | 11/2010 | Chen | |
| 2008/0152482 | A1 | 6/2008 | Patel | |

* cited by examiner

*Primary Examiner* — Edward Look
*Assistant Examiner* — William Grigos

(57) ABSTRACT

A portable air displacement system for introducing or removing air from a zone has a cylindrical fan housing with an exhaust aperture located on a housing side wall of a housing anterior end. The fan housing has a raised dome with a primary directional intake nozzle located on a raised dome posterior end. The raised dome has a plurality of secondary intake slots located around an arc on a dome anterior side, a dome first side and a dome second side. The system has a centrifugal fan located in the housing cavity connected to a power supply and a power switch. The system has a positioning platform with a first panel and a second panel pivotally attached to housing posterior end for clasping a planar object on either side.

8 Claims, 9 Drawing Sheets

PORTABLE AIR DISPLACEMENT SYSTEM

CROSS REFERENCE

This application is a continuation-in-part of U.S. patent application Ser. No. 12/555,712 filed Sep. 8, 2009, which is a non-provisional of U.S. Patent Application No. 61/191,216 flied Sep. 8, 2008, the specification of which is incorporated herein by reference in its entirety.

BACKGROUND OF THE INVENTION

Sometimes a ventilation system is needed for personal comfort for an individual or for providing circulating air to an object. Standard cooling and circulating devices can be bulky and difficult to move from place to place. The present invention features a portable air displacement system for introducing or removing air from a zone.

SUMMARY

The present invention features a portable air displacement system for introducing or removing air from a zone. In some embodiments, the system comprises a hollow, cylindrical fan housing. In some embodiments, the fan housing has an exhaust aperture located on a housing side wall of a housing anterior end. In some embodiments, the fan housing comprises a raised dome with a primary directional intake nozzle located on a raised dome posterior end. In some embodiments, the raised dome comprises a plurality of secondary intake slots located around an arc on a dome anterior side, a dome first side and a dome second side.

In some embodiments, the system comprises a centrifugal faro located in the housing cavity operatively connected to a power supply and a power switch. In some embodiments, the system comprises a positioning platform having a generally planar first panel and a generally planar second panel pivotally attached to housing posterior end. In some embodiments, the first panel and the second panel are adapted to clasp a planar object on either side for holding the system.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
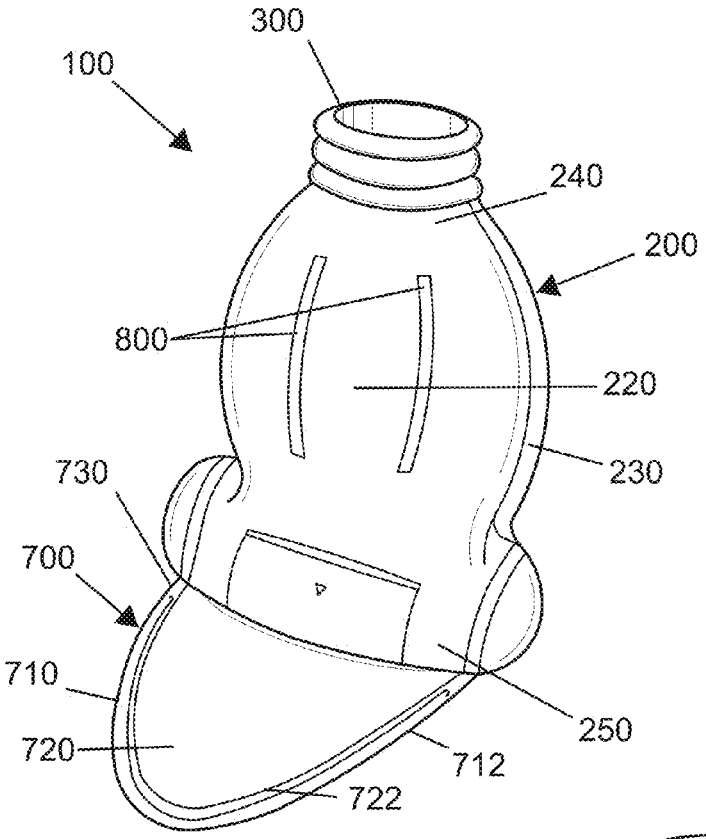
FIG. 1 is a perspective view of the bottom of the present invention.
Figure 2:
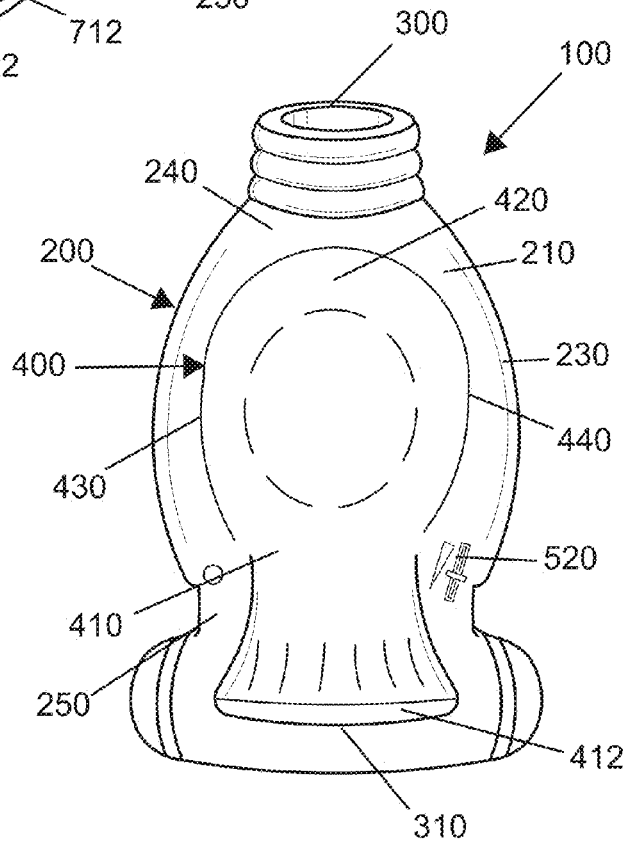
FIG. 2 is a perspective view of the top of the present invention.
Figure 3:
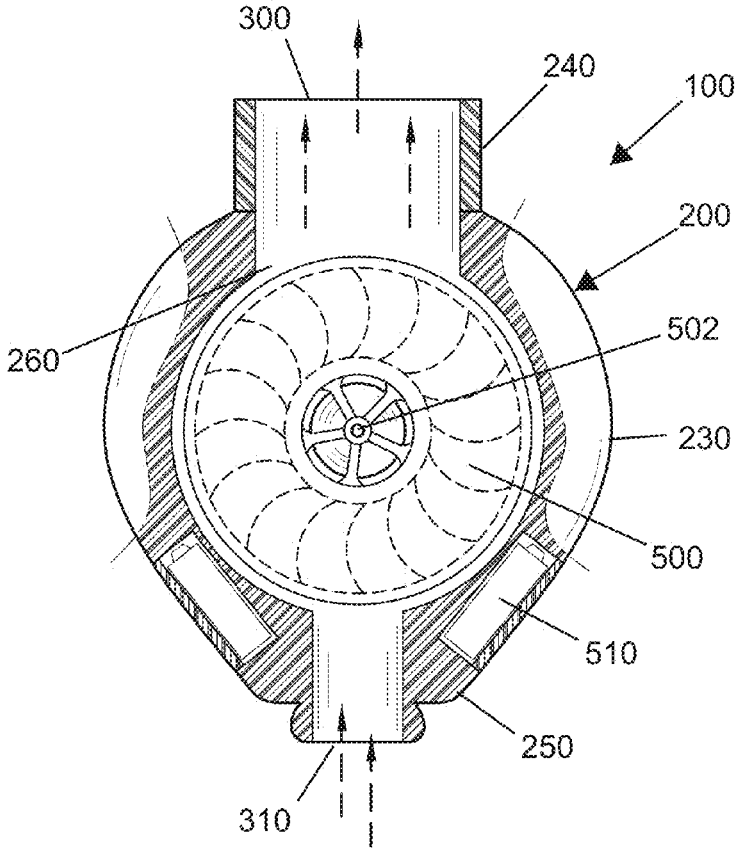
FIG. 3 is a cross-sectional view in a transverse plane of the present invention.
Figure 4:
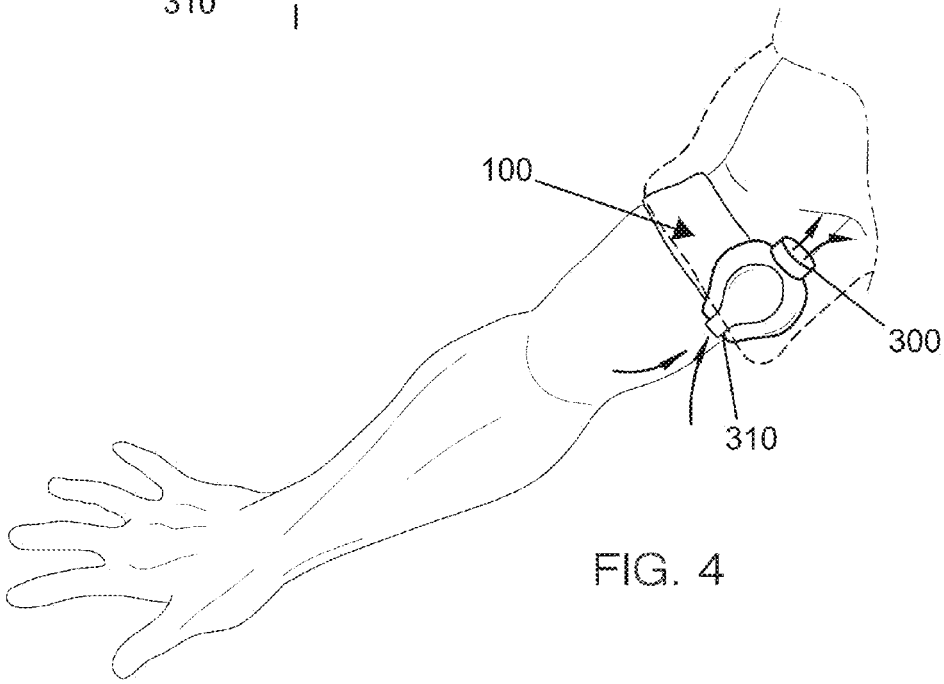
FIG. 4 is a view of the present invention in use.
Figure 5:
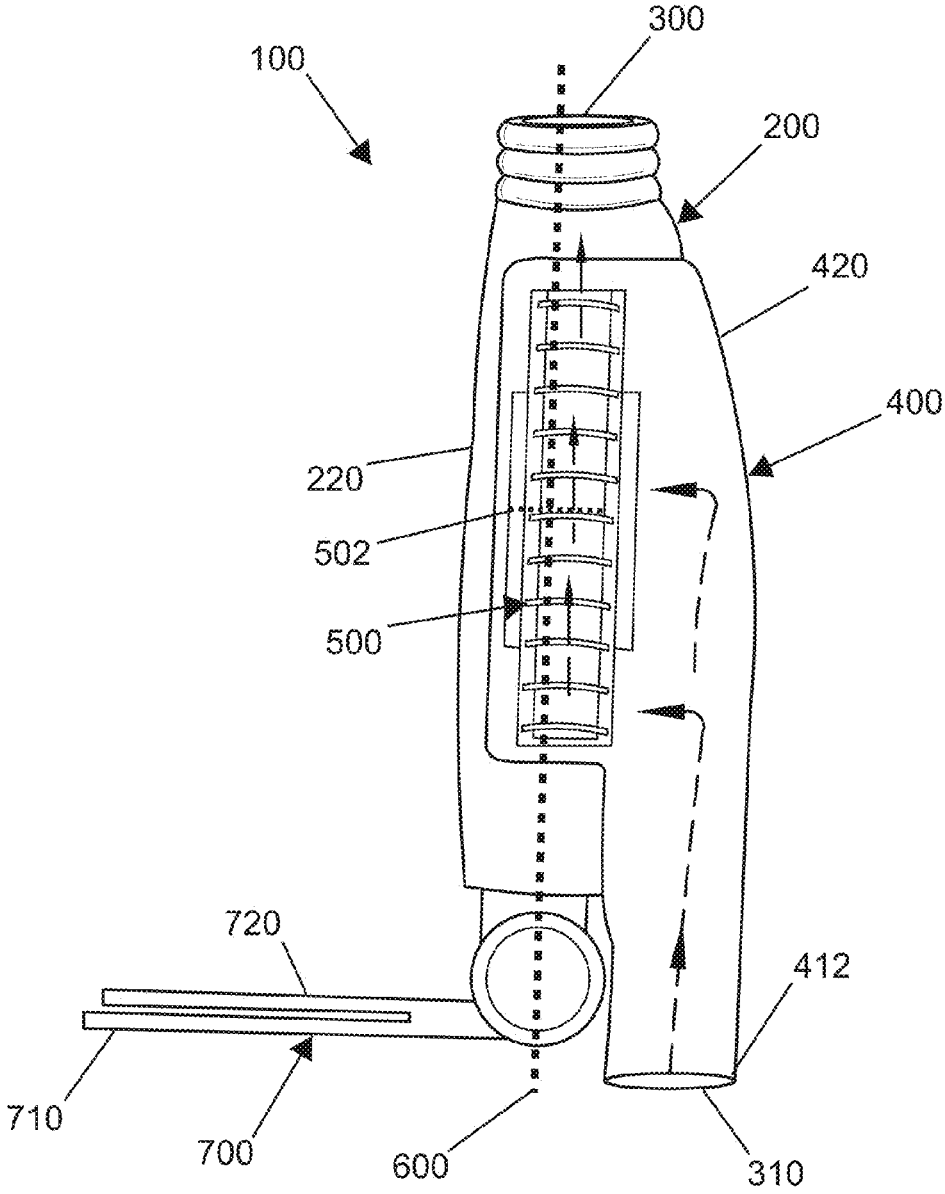
FIG. 5 is a side view of the present invention.
Figure 6:
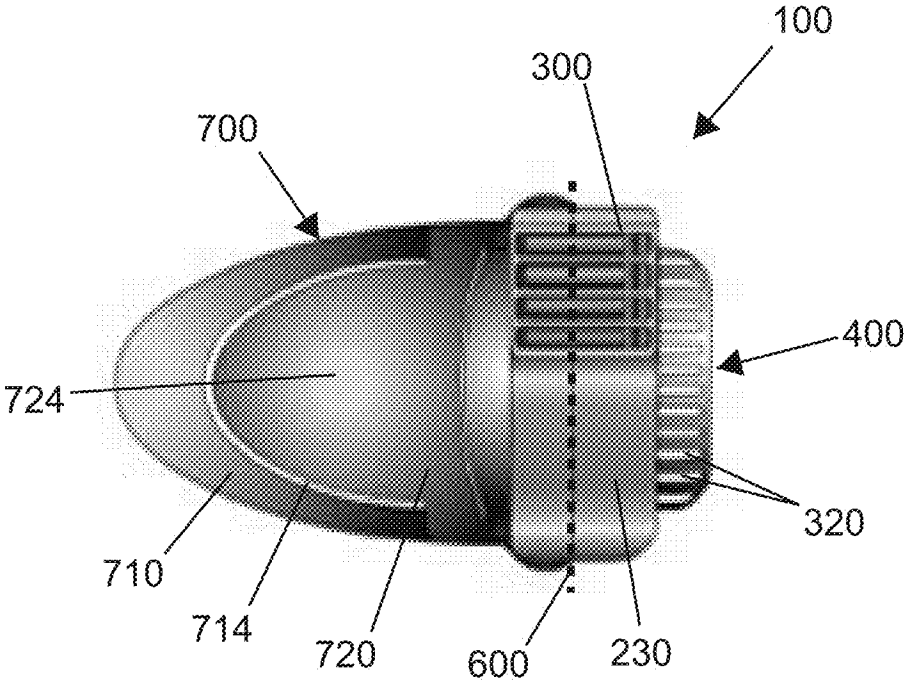
FIG. 6 is an anterior view of the present invention.
Figure 7:
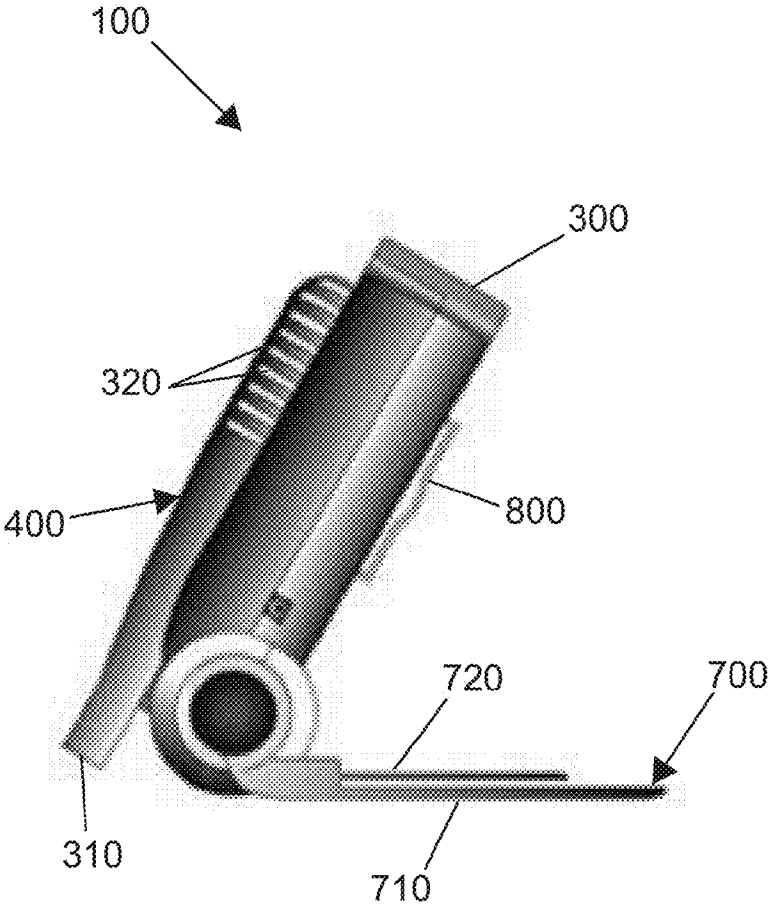
FIG. 7 is a side view of the present invention.
Figure 8:
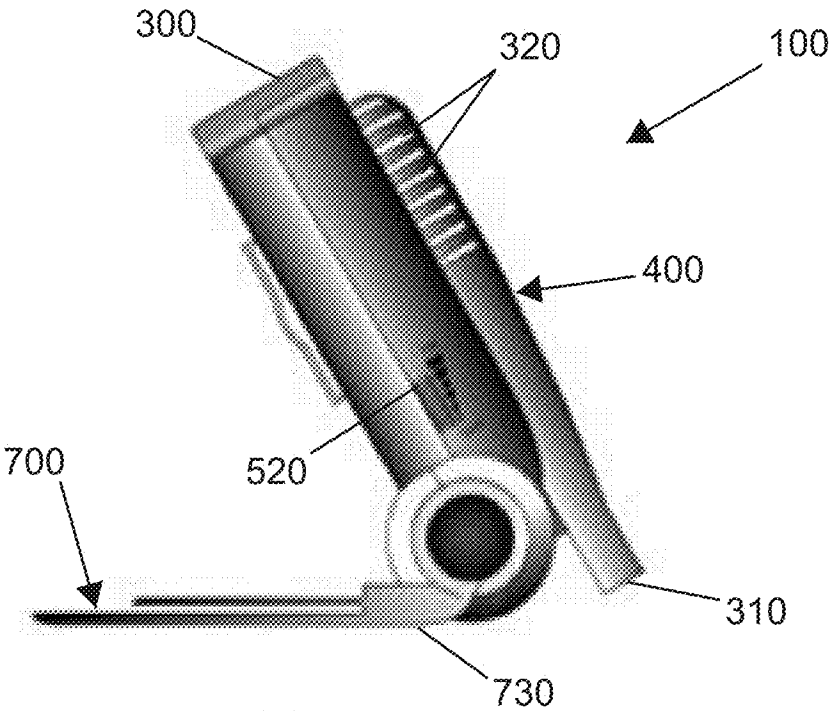
FIG. 8 is a side view of the present invention.
Figure 9:
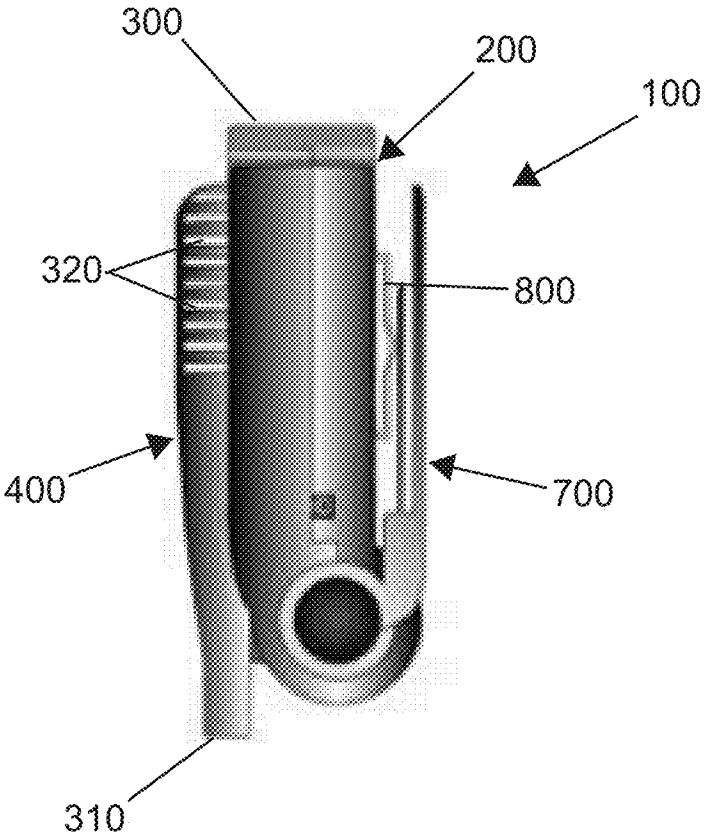
FIG. 9 is a side view of the present invention.
Figure 10:
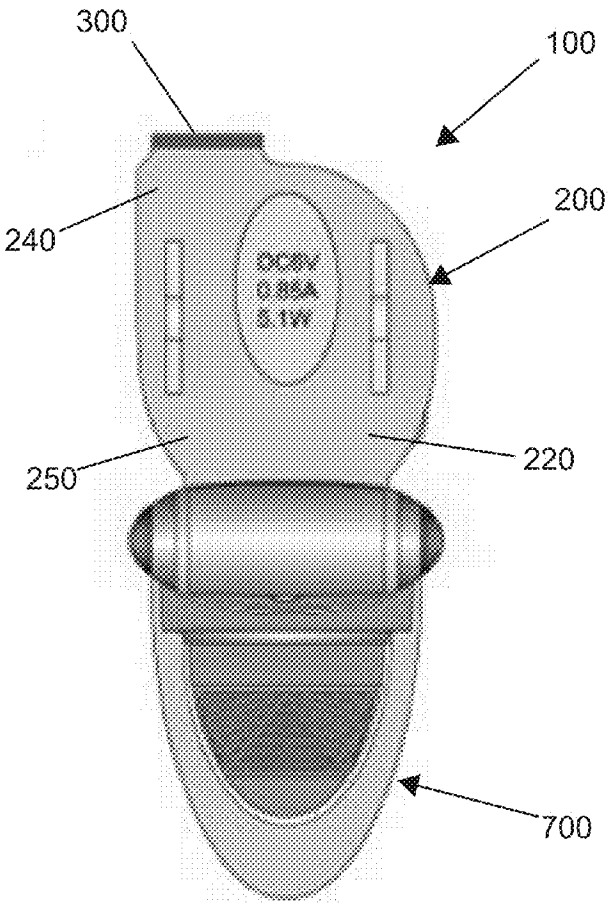
FIG. 10 is a bottom view of the present invention.
Figure 11:
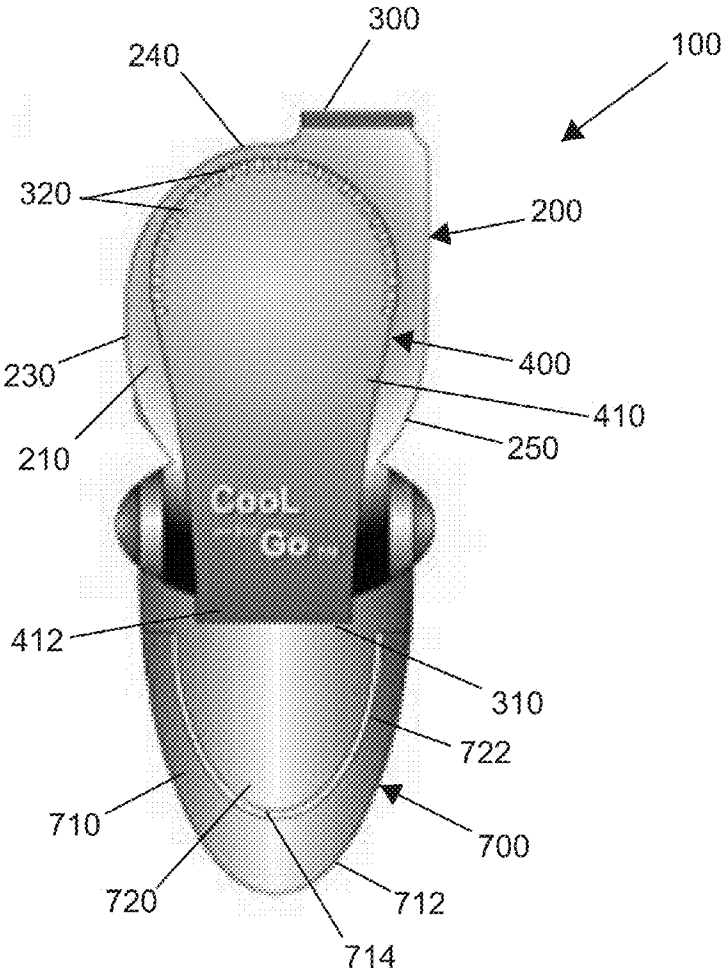
FIG. 11 is a top view of the present invention.

Following is a list of elements corresponding to a particular element referred to herein:

100 Portable air displacement system
200 Fan housing
210 Housing top side
220 Housing bottom side
230 Housing side wall
240 Housing anterior end
250 Housing posterior end
260 Housing cavity
300 Exhaust aperture
310 Primary directional intake nozzle
320 Secondary intake slots
400 Raised dome
410 Dome posterior side
412 Dome posterior side terminating end
420 Dome anterior side
430 Dome first side
440 Dome second side
500 Centrifugal fan
502 Centrifugal fan axis
510 Power supply
520 Power switch
600 Plane A
700 Positioning platform
710 First panel
712 First panel outer periphery
714 First panel open center
720 Second panel
722 Second panel outer periphery
724 Second panel inside surface
730 Positioning platform posterior end
800 Belt strap Referring now to FIG. 1-11, the present invention features a portable air displacement system (100) for introducing or removing air from a zone. In some embodiments, the system (100) blows air into a zone. In some embodiments, the system (100) removes air from a zone.

In some embodiments, the system (100) comprises a generally cylindrical fan housing (200) having a housing top side (210), a housing bottom side (220), a housing side wall (230), a housing anterior end (240), and a housing posterior end (250). In some embodiments, the fan housing (200) has a housing cavity (260) located therein fluidly connected to an exhaust aperture (300) located on the housing side wall (230) of the housing anterior end (240). In some embodiments, the housing top side (210) is generally planar. In some embodiments, the housing bottom side (220) is generally planar. In some embodiments the housing side wall (230) is perpendicular to the housing top side (210) and or the housing bottom side (220). In some embodiments, the exhaust aperture (300) projects out and away from the housing side wall (230). In some embodiments, the exhaust aperture comprises vanes over the exhaust aperture (300) to prohibit objects from entering inside.

In some embodiments, the fan housing (200) comprises a raised dame (400) located on the housing top side (210). In some embodiments, the raised dome (400) is fluidly connected to the housing cavity (260) In some embodiments, the raised dome (400) comprises a tapering dome posterior side terminating end (412) extending past the housing posterior end (250). In some embodiments, the raised dome comprises a primary directional intake nozzle (310) located on a raised dome posterior side terminating end (412) and fluidly connected to the housing cavity (260), in some embodiments, the primary directional intake nozzle (310) is located opposed to the exhaust aperture (300). In some embodiments, the primary directional intake nozzle (310) faces opposed to the exhaust aperture (300).

In some embodiments, the raised dome (400) comprises a plurality of secondary intake slats (320) radially located around an arc on a dome anterior side (420), a dome first side (430) and a dome second side (440). In some embodiments, the secondary intake slots (320) are not located on a dome posterior side (410). In some embodiments, the secondary intake slots (320) are fluidly connected to the housing cavity (260).

In some embodiments, it is critical for the system (100) to have both the primary directional intake nozzle (310) and the secondary intake slots (320). Each intake source pulls air from a different direction (location). The primary directional intake nozzle (310) can be used for localized venting. The secondary intake slots (320) provide air if the primary directional intake nozzle (310) becomes blocked. The presence of the secondary intake slots (320) allows for a smaller primary directional intake nozzle (310) which increases versatility while preserving the longevity of the system (100).

In some embodiments, the system (100) comprises a centrifugal fan (500) located in the housing cavity (260) operatively connected to a power supply (510) and a power switch (520). In some embodiments, a transverse plane, Plane A (600), is located at a midpoint of the housing separating the housing top side (210) from the housing bottom side (220). In some embodiments, a centrifugal fan axis (502) is perpendicularly located with respect to Plane A (600).

In some embodiments, the system (100) comprises a positioning platform (700) having a generally planar first panel (710) and a generally planar second panel (720) offset from the first panel (710). In some embodiments, the positioning platform (700) is pivotally attached to housing posterior end (250) on a positioning platform posterior end (730), in some embodiments, the first panel (710) comprises a first panel outer periphery (712) generally shaped like a semi-ellipse with a first panel open center (714) also shaped like a semi-ellipse. In some embodiments, the second panel (720) comprises a second panel outer periphery (722) generally shaped like a semi-ellipse having a solid center. In some embodiments the second panel outer periphery (722) is adapted to fit inside the first panel open center (714). In some embodiments, the first panel (710) is biased toward the second panel (720). In some embodiments, the first panel (710) and the second panel (720) are adapted to clasp or clip onto a planar object on either side, for example, a waist band of pants, a sleeve of a shirt, an edge of a canopy, a belt, or a strap. In some embodiments, the positioning platform posterior end (730) is located opposed to the exhaust aperture (300).

In some embodiments, the positioning platform (700) pivots in a 180 degree arc. In some embodiments, the positioning platform (700) is infinitely positionable within the 180 degree arc. In some embodiments, the positioning platform (700) is a stand to be used to position the system (100) on a planar surface. In some embodiments, the positioning platform (700) pivots in a 180 degree arc perpendicular to Plane A (600).

In some embodiments, a second panel inside surface (724) comprises a non-slip component.

In some embodiments, the housing bottom side (220) comprises a plurality of belt straps (800) longitudinally located in-line with the primary directional intake nozzle (310) and the exhaust aperture (300).

In some embodiments, the power supply (510) is a universal serial bus (USB) port. In some embodiments, the power supply (510) is a direct current power supply (510) or a battery. In some embodiments, batteries are located in a cavity located in the housing anterior end.

In some embodiments, the centrifugal fan (500) is adapted to be a variable speed centrifugal fan (500) with a variable speed power switch (520).

As used herein, the term "about" refers to plus or minus 10% of the referenced number. For example, an embodiment wherein the housing is about 10 inches in length includes a housing that is between 9 and 11 inches in length.

The disclosures of the following U.S. patents are incorporated in their entirety by reference herein: U.S. Pat. No. 2,826,758; U.S. Pat. No. 3,096,702; U.S. Pat. No. 5,217,408; U.S. Pat. No. 5,564,124; U.S. Pat. No. 6,125,636; U.S. Pat. No. 6,188,881; U.S. Pat. No. 6,543,247; U.S. Pat. No. 6,666,647; and U.S. Pat. No. 8,955,524.

Various modifications of the Invention, in addition to those described herein, will be apparent to those skilled in the art from the foregoing description. Such modifications are also Intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A portable air displacement system (100) for introducing or removing air from a zone, wherein said system (100) comprises:

(a) a generally cylindrical fan housing (200) having a housing top side (210), a housing bottom side (220), a housing side wall (230), a housing anterior end (240), and a housing posterior end (250), wherein the fan housing (200) has a housing cavity (260) disposed therein fluidly connected to an exhaust aperture (300) disposed on the housing side wall (230) of the housing anterior end (240), wherein the fan housing (200) comprises a raised dome (400) disposed on the housing top side (210), wherein the raised dome (400) is fluidly connected to the housing cavity (260), wherein the raised dome (400) comprises a tapering dome posterior side terminating end (412) extending past the housing posterior end (250), wherein the raised dome (400) comprises a primary directional intake nozzle (310) disposed on the raised dome posterior side terminating end (412) and fluidly connected to the housing cavity (260), wherein the primary directional intake nozzle (310) is disposed opposed to the exhaust aperture (300), wherein the raised dome (400) comprises a plurality of secondary intake slots (320) radially disposed around an arc on a dome anterior side (420), a dome first side (430), and a dome second side (440), wherein the secondary intake slots (320) are not disposed on a dome posterior side (410), wherein the secondary intake slots (320) are fluidly connected to the housing cavity (260);

(b) a centrifugal fan (500) disposed in the housing cavity (260) operatively connected to a power supply (510) and a power switch (520), wherein a transverse plane, Plane A (600), is disposed at a midpoint of the housing separating the housing top side (210) from the housing bottom side (220), wherein a centrifugal fan axis (502) is perpendicularly disposed with respect to Plane A (600); and (c) a positioning platform (700) having a generally planar first panel (710) and a generally planar second panel (720) offset from the first panel (710), wherein the positioning platform (700) is pivotally attached to housing posterior end (250) on a positioning platform posterior end (730), wherein the first panel (710) comprises a first panel outer periphery (712) generally shaped like a semi-ellipse with a first panel open center (714) also shaped like a semi-ellipse, wherein the second panel (720) comprises a second panel outer periphery (722) generally shaped like a semi-ellipse having a solid center, wherein the second panel outer periphery (722) is adapted to fit inside the first panel open center (714), wherein the first panel (710) is biased toward the second panel (720), wherein the first panel (710) and the second panel (720) are adapted to clasp a planar object on either side, wherein the positioning platform posterior end (730) is disposed opposed to the exhaust aperture (300).

2. The system (100) of claim 1, wherein the positioning platform (700) pivots in a 180 degree are perpendicular to Plane A (600).

3. The system (100) of claim 2, wherein the positioning platform (700) is infinitely positionable within the 180 degree arc.

4. The system (100) of claim 1, wherein a second panel inside surface (724) comprises a non-slip component.

5. The system (100) of claim 1, wherein the housing bottom side (220) comprises a plurality of belt straps (800) longitudinally disposed in-line with the primary directional intake nozzle (010) and the exhaust aperture (300).

6. The system (100) of claim 1, wherein the power supply (510) is a universal serial bus (USB) port.

7. The system (100) of claim 1, wherein the power supply (510) is a direct current power supply (510) or a battery.

8. The system (100) of claim 1, wherein the centrifugal fan (500) is adapted to be a variable speed centrifugal fan (500) with a variable speed power switch (520).

* * * * *